US007568553B2

(12) United States Patent
Wiebel et al.

(10) Patent No.: US 7,568,553 B2
(45) Date of Patent: Aug. 4, 2009

(54) NOISE BARRIER SYSTEM COMPOSED OF A BASE WITH A TRANSPARENT SUPERSTRUCTURE

(75) Inventors: Wolffgang Wiebel, Haibach (DE); Klaus Lublow, Boenen (DE); Klaus Oberlaender, Hanau (DE); Norbert Brand, Darmstadt (DE); Reiner Lingelbach, Muenster (DE); Peter Seelmann, Vienna (AT)

(73) Assignee: Roehm GmbH & Co. KG, Darmstadt (DE)

( * ) Notice: Subject to any disclaimer, the term of this patent is extended or adjusted under 35 U.S.C. 154(b) by 464 days.

(21) Appl. No.: 10/546,525

(22) PCT Filed: Oct. 9, 2003

(86) PCT No.: PCT/EP03/11162

§ 371 (c)(1), (2), (4) Date: Aug. 23, 2005

(87) PCT Pub. No.: WO2004/083525

PCT Pub. Date: Sep. 30, 2004

(65) Prior Publication Data

US 2006/0185268 A1 Aug. 24, 2006

(30) Foreign Application Priority Data

Mar. 21, 2003 (DE) ..... 103 12 783

(51) Int. Cl.
*E04B 1/82* (2006.01)

(52) U.S. Cl. ..... 181/289; 181/284; 181/285; 181/210; 52/144; 52/145

(58) Field of Classification Search ..... 181/144, 181/145, 284, 289, 285, 210; 52/284, 289, 52/285, 210, 144, 145
See application file for complete search history.

(56) References Cited

U.S. PATENT DOCUMENTS 4,175,639 A * 11/1979 Wirt ..... 181/210

(Continued)

FOREIGN PATENT DOCUMENTS

DE 1 534 499 6/1969

(Continued)

OTHER PUBLICATIONS

U.S. Appl. No. 10/586,878, filed Jul. 21, 2006, Seelmann, et al.

*Primary Examiner*—Jeffrey Donels
*Assistant Examiner*—Jeremy Luks
(74) *Attorney, Agent, or Firm*—Oblon, Spivak, McClelland, Maier & Neustadt, P.C.

(57) ABSTRACT

A noise barrier system composed of a base and a transparent superstructure. A support holds at least two adjacent transparent noise barrier elements and includes a point-fastening of the transparent noise barrier element. A position of upper holding points of the transparent superstructure is arranged at a height of from 70 to 90% of a total height of the transparent noise barrier element and at a distance of from 3 to 50 times a thickness of the transparent noise barrier element from a vertical edge. An upper side of the transparent noise barrier element has a flexure, an angle of the flexure being from 30° to 90° from vertical, and a width of an angled region being from 5 cm to 50 cm, and an entire length of a lower side of the sheet is secured within a groove-shaped depression.

20 Claims, 2 Drawing Sheets

U.S. PATENT DOCUMENTS

| | | | | | |
|---|---|---|---|---|---|
| 4,214,411 | A | * | 7/1980 | Pickett | 52/144 |
| 5,015,119 | A | * | 5/1991 | Schmanski | 404/12 |
| 5,294,472 | A | | 3/1994 | Arnold et al. | |
| 5,619,829 | A | * | 4/1997 | Tan et al. | 52/293.3 |
| 5,678,364 | A | * | 10/1997 | Shima et al. | 52/169.3 |
| 5,739,482 | A | * | 4/1998 | Shima et al. | 181/210 |
| 5,942,736 | A | * | 8/1999 | Cortonesi | 181/289 |
| 5,965,852 | A | * | 10/1999 | Roschke | 181/210 |
| 5,971,096 | A | * | 10/1999 | Matsumoto et al. | 181/210 |
| 6,006,858 | A | * | 12/1999 | Shima et al. | 181/210 |
| 6,016,887 | A | * | 1/2000 | Underhill et al. | 181/210 |
| 6,019,189 | A | * | 2/2000 | Shima et al. | 181/210 |
| 6,149,338 | A | * | 11/2000 | Anderson | 404/6 |
| 2005/0016213 | A1 | | 1/2005 | Hasskerl et al. | |
| 2006/0185268 | A1 | | 8/2006 | Wiebel et al. | |

FOREIGN PATENT DOCUMENTS

| | | |
|---|---|---|
| DE | 8524319 | 10/1985 |
| DE | 42 30 786 | 5/1994 |
| DE | 199 06 989 | 9/2000 |
| EP | 0 213 521 | 3/1987 |
| EP | 0 530 512 | 3/1993 |
| EP | 0 531 982 | 3/1993 |
| EP | 0 589 346 | 3/1994 |
| EP | 0 908 563 | 4/1999 |
| FR | 2 697 040 | 4/1994 |
| WO | 98/01625 | 1/1998 |

* cited by examiner

NOISE BARRIER SYSTEM COMPOSED OF A BASE WITH A TRANSPARENT SUPERSTRUCTURE

The present invention relates to a noise barrier system composed of a base with a sound-deadening sheet composed of a transparent plastic or composed of silicate glass.

Sheet systems of the type described above generally have a structure composed of two or more sheets of square-meter dimensions, in particular of transparent plastics sheets, where the sheets have been arranged alongside one another and each pair of adjacent sheets is held together by a support and fixed to the substrate or to the base or to the substructure of the noise barrier system. Other materials whose use is preferred, besides silicate glass, are transparent plastics, such as polymethyl methacrylate (PMMA) or polycarbonate (PC).

These supports are usually a double-T support, the two adjacent sheets being fixed with a certain separation from one another in contact with one T of the support, and protected by a rubber profile. These sheets are held by a flat steel section which is in contact with those end regions of the sheets oriented towards the double-T support, and which is connected by means of a plurality of fastening screws to the double-T support through the gap between the sheets.

A noise barrier of this type is simple to construct, inexpensive with respect to support elements, and provides acceptable protection for the sheets from the stresses customarily caused by traffic. However, a disadvantage of this solution is that the support posts are very wide in order to provide the necessary recess lengths, in each case at least 50 mm.

PRIOR ART

The publication "Lärmschutzwände auf Brücken" [Noise barriers on bridges] (Verkehrsblatt-Verlag, 1995) reviews the noise barrier structures known at that time. The noise barriers have to meet increased design requirements on bridges where the available space is restricted, and in built-up areas.

Previously, functional features were of prime importance, examples being sound-deadening, stability and structure, but aesthetic aspects are becoming increasingly important.

Transparent noise barriers have the advantage of providing an unhindered view of the landscape, and make the external appearance of the traffic route less like an impenetrable wall. In addition, there is no adverse effect on the silhouette of bridges.

If the structure is a combination of a non-transparent base and a transparent superstructure, this gives the traveller a certain feeling of safety, especially on bridges.

If plastics sheets are secured in these supports, the result of this installation technique can be that the mounting allows a degree of free movement, permitting a small angular movement between post and plastics sheet, with resultant adverse effect on compliance with the requirement of the supplementary technical specification Lärmschutzwand [Noise barrier] 1988 (ZDV LSW 88) for a maximum deflection of 175 on exposure to the loadings arising from traffic.

DE-U 85 24 319.1 or EP-A-0 213 521 has disclosed glazing stanchions for the erection of noise barriers which comprise large-surface-area sheets of transparent plastic between vertical posts, these being similar to the supports mentioned at the outset. These systems make it possible to use instead of a double-T support, a box-section tube whose dimensions correspond to those of the double-T support. The individual sheets are placed separated from one another in contact with one of the lateral surfaces of the box-section tube, and clamped against the box-section tube by means of a clamping rail and an appropriate number of screws through the gap between the individual sheets. The structure is adequately wind-resistant, but needs relatively wide box-section tubes for that purpose. Assistance in this respect is provided, by way of example, by EP-A-0 530 512. That publication discloses a sheet system which does not have the sheets anchored to the support in such a way that they are flush, with a gap, but has them partially overlapping one another and anchored to the support through the overlap and through the area of contact with the support. This method can approximately halve the required support width without adversely affecting stability. Although this gives a more attractive appearance, in particular for barrier systems and specifically for transparent noise barriers, because the supports are slim and do not have the previous ungainly appearance, the technique disclosed in EP-A-0 530 512 still requires relatively small post separations of about 2 meters, and also requires that the mounting of the sheets extend over the entire height of up to 3 meters.

Methods have previously been proposed both for increasing the post separation and for increasing the unsupported protruding height. By way of example, DE-A 42 30 786 gives a proposal in this connection. The noise barrier segments which it discloses have a substantially rectangular frame, the edge of which can be inserted into the profile of 2 vertical support posts and can be locked within these. Sound-deadening sheets composed of plastic have been inserted into the frame itself, which is composed of 2 vertical members, a lower member, and an upper horizontal member divided into two sections, and are held releasably. The required height for the frame is merely about ⅔ of the height of the sound-deadening sheet, and a protruding height of up to 50% is therefore achievable. Although the protruding height and the greater post separation, up to 6 meters, considerably improves visibility, which is otherwise severely impaired in known noise barriers by the short distance between posts, a particular concern is that the appearance of this noise barrier remains weighty and oppressive. EP 908563 describes noise barrier segments composed of plastic and fastened to a support, where the sheet has an articulated point mounting such that the means of fastening can adopt the line of flexing of the sheet under load. The solution leads to a very finely structured appearance of the means of fastening of the sheet, but there is no resultant reduction in the post width needed.

DE 19906989 relates to a noise barrier segment for roads, motorways or railways, the noise barrier segment being composed of transparent sheets, for example transparent plastics sheets, with the means of fixing the sheets. The transparent sheet is shaped around a perpendicular to the installation surface of the assembled noise barrier, the term "shaping" meaning arching and/or folding. This shaping gives the noise barrier intrinsic stability. A noise barrier composed of these segments is transparent over its entire length and height, because no holder posts or support structures are needed between the individual segments. After installation, the segments, preferably prestressed, are supported laterally by one another, and at the ends of the barrier, or at freely selectable distances, are supported by holder posts. A disadvantage of this solution is the insertion depth required by the flexing of the noise barrier segments. Many installation sites simply cannot provide the additional width.

EP 589 346 describes another system. The invention relates to a noise barrier segment composed of two support posts with vertical edges, and of a substantially rectangular frame, the edge of which has been attached to the vertical support posts, where the frame has two vertical members and one lower horizontal member. This solution dispenses with any support post in the upper transparent region of the noise barrier, but the noise barrier requires a disproportionately great recess depth.

Object

When the occupant of a means of transport travels past a noise barrier whose structure is that of the prior art, the succession of transparent noise barrier and massive fastening posts produces an unattractive staccato effect, due to the succession of light and dark effects. The object was therefore to design a transparent noise barrier in such a way as very substantially to eliminate this unattractive staccato effect and to enable the traveller to perceive the transparent impression with no substantial hindrance. The fastening system must withstand the customary loads due to traffic and, particularly on bridges, must have only modest space requirements.

Achievement of Object

The object is achieved by an arrangement of the fastening points of the transparent noise barrier segment according to claim 1. The technique used for the fastening point is the method described in EP 908 563, FIG. 1 and in the Description, p. 1, Paragraph 009 to p. 54, Paragraph 035. This fastening technique can fasten noise barrier segments with dimensions of 2×3 meters and with thicknesses of about 20 mm in such a way as to give compliance with the customary static requirements (intrinsic loading, wind loading).

Longer spans have not hitherto been achieved using the fastening system.

It has now been found that the length of the transparent noise barrier segments to be secured can be more than doubled if the fastening points are arranged such that the arrangement of the upper holding points of the transparent noise barrier segment is at a height of from 70 to 90% of the total height of the transparent noise barrier segment.

According to the invention, the upper holding points of the transparent noise barrier segment have been arranged at a distance of from 3 to 50 times the thickness of the transparent noise barrier element from the vertical edge of the sheet. For example, in the case of a noise barrier element of thickness 20 mm the upper holding points would therefore be at a distance of from 60 to 1 000 mm from the vertical edge of the sheet.

The entire length of the lower side of the sheets is secured within a groove-shaped depression. The depth of this groove is from 2 cm to 25 cm, preferably from 3 to 15 cm, and particularly preferably from 4 to 10 cm.

The post separation may be up to 5 m. The separation may also be up to 10 m if another point-fastening has been arranged approximately at the centre. The post separation is preferably 5 m or 10 m.

The undesirable staccato effect is markedly reduced by the greater post separations achieved by the inventive fastening.

The base of the noise barrier system may be transparent or non-transparent. Where appropriate, non-transparent bases may also be designed to be sound-deadening, and appropriate materials here are known to the person skilled in the art, an example being sound-deadening concrete.

The sound-deadening sheet is composed of plastic or of silicate glass, and is preferably transparent and reflects the sound.

The transparent plastics which may be used comprise polymethyl methacrylate (PMMA), polycarbonate (PC), or polyethylene terephthalate (PET).

The polymethyl methacrylate (PMMA) may be prepared by polymerization using a casting method or polymerization using an extrusion method. The transparent PMMA sheets may be produced by polymerization using a casting method, or by extrusion, with embedding of polyamide threads, where appropriate, for binding splinters. Both production methods are known to the person skilled in the art. (Ullmann, 6th edition, Vol. 28, pp. 377 et seq.). The PMMA sheets may have reinforcement, as described in EP-A 407 852 or EP-A 531 982.

The height of the transparent noise barrier is from 1 m to 4 m. This height may be achieved by a single-section transparent noise barrier or by a noise barrier composed of two or more sheets mutually superposed, in which case use is to be made of suitable jointing components.

Another embodiment of the invention is characterized in that the upper part of the noise barrier segment has an angled section.

Depending on requirements, the width of the angled section may be from 5 to 50 cm. Angled sections of from 10 to 20 cm are preferred. The angle of the angled region of the noise barrier element from vertical is from 30° to 90°, preferably from 45 to 60°. The angled region is self-supporting. The flexure in the transparent noise barrier segment may be brought about by deflecting the edge of the element, but it is also possible to attach a separate transparent sheet by means of an adhesive bond.

The thickness of the transparent noise barrier element may vary within relatively wide limits, and the use of sheet thicknesses of from 10 to 50 mm has proven successful.

The ratio between the transparent sound-deadening sheet and the base of the noise barrier may be from 1:10 to 10:1, preferably from 1:5 to 5:1, and particularly preferably from 1:2 to 2:1.

EXPLANATION OF DRAWINGS

FIG. 1 shows a noise barrier system with a post separation of up to 5 m, the sheets of the transparent superstructure having been fastened by means of posts (4).

FIG. 2 shows a noise barrier system with a post separation of up to 10 m, the sheets of the transparent superstructure having been fastened by means of posts (4) and by means of a further point-fastening (6) of the post (5) arranged approximately at the centre.

KEY

1=base

2=transparent superstructure

3=angled upper portion of transparent noise barrier element

Figure 1:
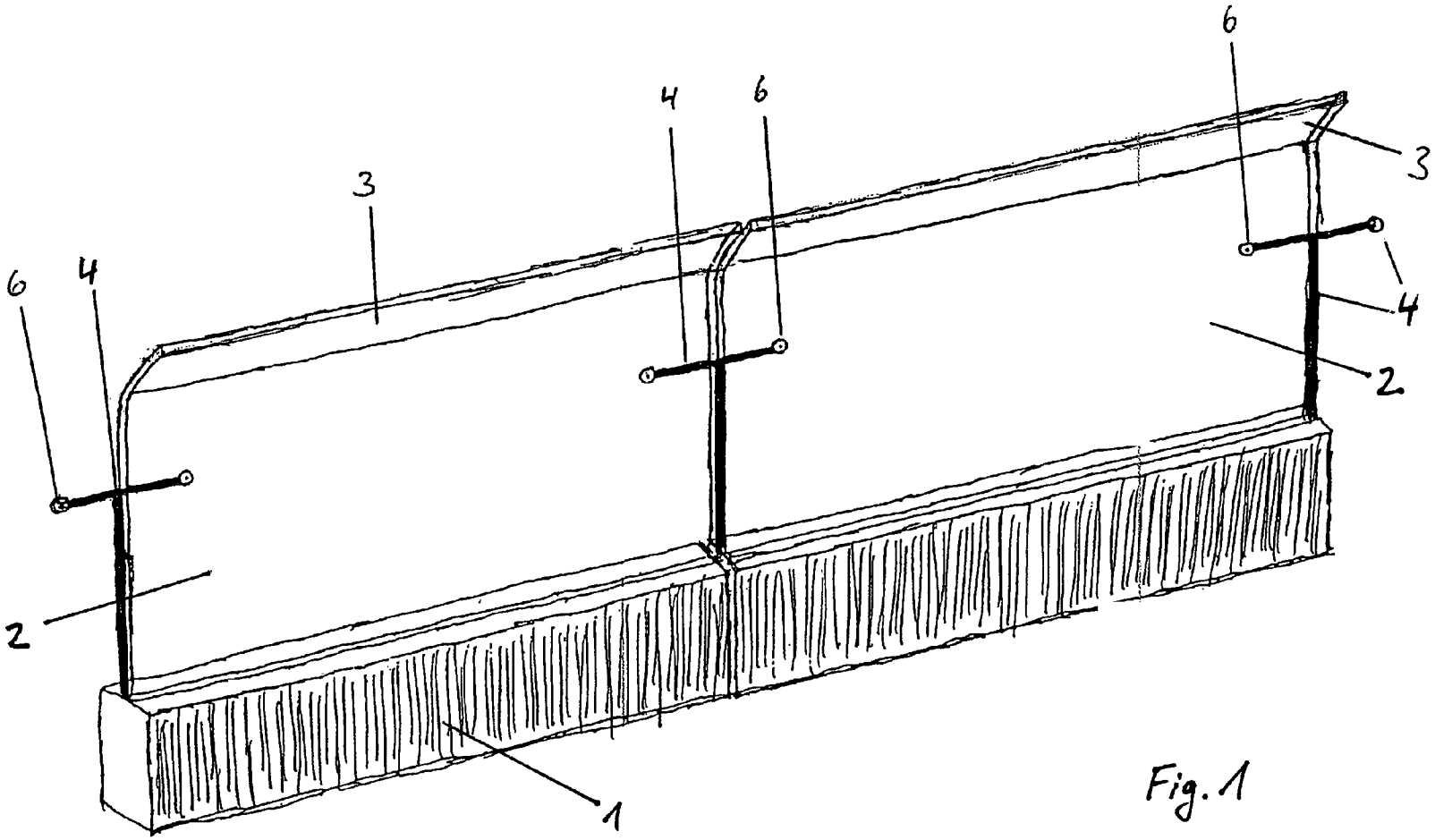
FIGS. 1 and 2 show—with no intention of any resultant restriction—a noise barrier system composed of a non-transparent base with a transparent superstructure.
Figure 2:
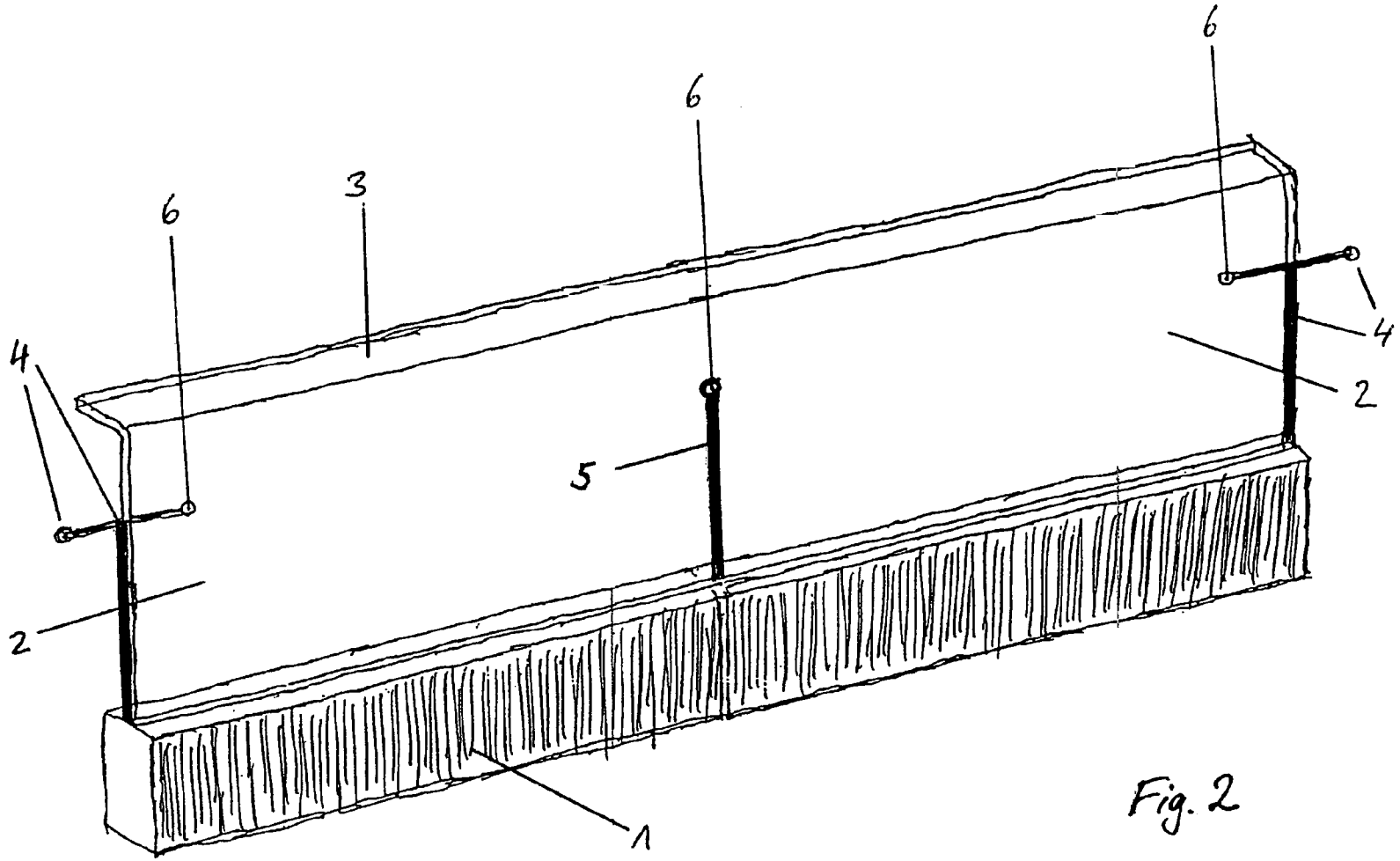

4=post (support), as described by way of example in EP 908 563, FIG. 1

5=post (support) for additional fastening approximately at the centre

6=point-fastening of transparent noise barrier element

The invention claimed is:

1. A noise barrier system comprising:

a base comprising a groove-shaped depression;

a transparent superstructure comprising at least two transparent noise barrier elements, wherein each transparent noise barrier element has a top portion, a bottom portion, a front surface, a back surface, and two sides;

a support holding the at least two adjacent transparent noise barrier elements that comprises a sequential point-fastening of the transparent noise barrier elements, wherein the sequential point-fastening connects a side of one transparent noise barrier element to the other side of another transparent noise barrier element so that the transparent noise barrier elements form essentially one plane;

wherein a position of upper holding points of the transparent superstructure is arranged at a height of from 70 to 90% of a total height of the transparent noise barrier element and at a distance of from 3 to 50 times a thickness of the transparent noise barrier element from a vertical edge;

wherein the top portion of the transparent noise barrier element is flexed, and an angle of the flexure being from 30° to 90° from vertical, and a width of an angled region being from 5 cm to 50 cm; and wherein an entire length of the bottom portion of the fastened transparent elements is secured within the groove-shaped depression.

2. The noise barrier system according to claim 1, wherein the base is transparent.

3. The noise barrier system according to claim 1, wherein the base is non-transparent.

4. The noise barrier system according to claim 3, wherein the base is sound-deadening.

5. The noise barrier system according to claim 1, wherein an angle between the angled region and vertical is from 45° to 60°.

6. The noise barrier system according to claim 1, wherein the thickness of the transparent noise barrier element is from 10 mm to 50 mm.

7. The noise barrier system according to claim 1, wherein the width of the angled region is from 10 to 20 cm.

8. The noise barrier system according to claim 1, wherein support post separation is up to 5 m.

9. The noise barrier system according to claim 1, wherein support post separation is up to 10 m, and another point-fastening is arranged approximately at a center.

10. The noise barrier system according to claim 1, wherein the noise barrier comprises at least two portions composed of two or more sheets mutually superposed, and the height of the transparent noise barrier element is from 1 to 4 m.

11. The noise barrier system according to claim 1, wherein a ratio between the height of the transparent sound-deadening base and the height of the transparent noise barrier element is from 1:10 to 10:1.

12. The noise barrier system according to claim 1, wherein a transparent part of the noise barrier system provides a reflective sound-deadening function.

13. The noise barrier system according to claim 1, wherein an orientation of the flexure is towards a sound source.

14. The noise barrier system according to claim 1, wherein an orientation of the flexure is away from a sound source.

15. The noise barrier system according to claim 1, wherein the transparent superstructure is composed of mineral glass or of transparent plastics.

16. The noise barrier system according to claim 15, wherein the transparent plastics comprise polymethyl methacrylate (PMMA), polycarbonate (PC), or polyethylene terephthalate (PET).

17. The noise barrier system according to claim 16, wherein the PMMA is prepared by polymerization using a casting or extrusion method.

18. The noise barrier system according to claim 16, wherein the transparent PMMA sheet is produced by polymerization using a casting method, or by extrusion, with embedding of polyamide threads for binding splinters.

19. The noise barrier system according to claim 1, wherein said noise barrier system is a solid wall-like system.

20. The noise barrier system according to claim 1, wherein a transparent part of the noise barrier system provides both reflective and absorptive sound-deadening functions.

* * * * *